US009857720B2

(12) United States Patent
Nagai

(10) Patent No.: US 9,857,720 B2
(45) Date of Patent: Jan. 2, 2018

(54) FIELD EFFECT ELECTRIC CHARGER DEVICE AND IMAGE FORMING DEVICE

(71) Applicant: Konica Minolta, Inc., Chiyoda-ku, Tokyo (JP)

(72) Inventor: Yasuki Nagai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/271,665

(22) Filed: Sep. 21, 2016

(65) Prior Publication Data

US 2017/0082938 A1 Mar. 23, 2017

(30) Foreign Application Priority Data

Sep. 18, 2015 (JP) ..... 2015-184659

(51) Int. Cl.
*G03G 15/02* (2006.01)

(52) U.S. Cl.
CPC ..... *G03G 15/0283* (2013.01); *G03G 15/0291* (2013.01)

(58) Field of Classification Search
CPC ..... G03G 15/0233; G03G 15/025; G03G 15/0283; G03G 15/0291
USPC ..... 399/168, 170–172
See application file for complete search history.

(56) References Cited

U.S. PATENT DOCUMENTS 8,204,407 B2 * 6/2012 Zona et al. ..... G03G 15/0291 399/170
2009/0252535 A1 10/2009 Zona et al.
2011/0008240 A1 1/2011 Inoue et al.

FOREIGN PATENT DOCUMENTS

| | | | |
|---|---|---|---|
| JP | 2002279885 | A | 9/2002 |
| JP | 2006084951 | A | 3/2006 |
| JP | 2009196873 | A | 9/2009 |
| JP | 2009251601 | A | 10/2009 |
| JP | 2009251609 | A | 10/2009 |
| JP | 2010212309 | A | 9/2010 |
| JP | 2013216578 | A | 10/2013 |
| WO | 2012157506 | a1 | 11/2012 |

OTHER PUBLICATIONS

Yoku Inoue, "Continuous Dry-Spinning for Carbon Nanotube Yarn", Journal of the Imaging Society of Japan, vol. 53, No. 1, pp. 71-76, 2014, with partial English translation.
Notice of Reasons for Refusal for corresponding JP Patent Application No. 2015-184659; dated Sep. 26, 2017.

* cited by examiner

*Primary Examiner* — William J Royer
(74) *Attorney, Agent, or Firm* — Cantor Colburn LLP

(57) ABSTRACT

A field effect (FE) electric charger device that electrically charges a surface of a charge-target member, the FE electric charger device including: an electric charger element; a power source supplying the electric charger element with current; and a lead electrode generating an electric field upon voltage application and causing the electric charger element to discharge. In the FE electric charger device, the electric charger element has a density no smaller than 0.4 g/cm$^3$, and includes a plurality of filaments each including a plurality of sp$^2$ carbon molecules bonded together.

11 Claims, 13 Drawing Sheets

FIG. 7

| No | Size | | Acetylene gas | | CVD conditions | |
|---|---|---|---|---|---|---|
| | Diameter (nm) | Length (mm) | Flow amount (sccm) | Pressure (Toor) | Growth period (min) | Temperature (℃) |
| CNT1 | 40 | 0.8 | 200 | 10 | 10 | 820 |
| CNT2 | 40 | 1.1 | 100 | 10 | 20 | 820 |
| CNT3 | 40 | 2.1 | 200 | 10 | 20 | 820 |
| CNT4 | 40 | 0.5 | 200 | 10 | 5 | 820 |

FIG. 8

| No | CNT molecule | Filament diameter (nm) | Yarn diameter (μm) | Density (g/cm$^3$) | Electron discharge characteristics | | | Ozone generation amount (ppm) |
|---|---|---|---|---|---|---|---|---|
| | | | | | Vex (V) | Iem (μA) | V0 (V) | |
| HC1 | CNT1 | 40 - 400 | 60 | 0.41 | -600 | -100 | -500 | 0.01 |
| HC2 | CNT2 | 40 - 300 | 60 | 0.52 | -600 | -50 | -500 | 0.005 |
| HC3 | CNT3 | 40 - 200 | 60 | 0.77 | -600 | -10 | -500 | < 0.001 |
| HC4 | CNT2 | 40 - 300 | 30 | 1.02 | -600 | -50 | -500 | 0.005 |
| HC5 | CNT2 | 40 - 300 | 100 | 1.32 | -600 | -10 | -500 | < 0.001 |
| HC6 | CNT2 | 40 - 300 | 120 | 1.53 | -600 | -10 | -500 | < 0.001 |
| HC7 | CNT2 | 40 - 300 | 15 | 0.35 | ※ | ※ | ※ | ※ |
| HC8 | CNT4 | 40 - 450 | 60 | 0.30 | -600 | -200 | -500 | 0.02 |

FIG. 9

| No | Device type | Electric discharge characteristics | | | | Ozone generation amount (ppm) |
|---|---|---|---|---|---|---|
| | | Vg(V) | Vc(V) | Ic(μA) | V0(V) | |
| STD1 | Scorotron charger | -500 | -3,500 | -700 | -500 | 1 |
| STD2 | Roller charger | — | -1,100 | — | -500 | 0.01 |

"Conventional"

FIG. 13

| No | CNT molecule | Filament diameter (nm) | Density ($g/cm^3$) | Electron discharge characteristics | | | Ozone generation amount (ppm) |
|---|---|---|---|---|---|---|---|
| | | | | Vex (V) | Iem ($\mu$A) | V0 (V) | |
| HC11 | CNT2 | 40 - 200 | 0.48 | -600 | -50 | -500 | 0.005 |
| HC12 | CNT4 | 40 - 450 | 0.25 | -600 | -200 | -500 | 0.02 |

FIELD EFFECT ELECTRIC CHARGER DEVICE AND IMAGE FORMING DEVICE

CROSS-REFERENCE TO RELATED APPLICATIONS

The present invention claims priority under 35 U.S.C. §119 to Japanese Application No. 2015-184659 filed Sep. 18, 2015, the entire content of which is incorporated herein by reference.

BACKGROUND OF THE INVENTION

(1) Field of the Invention

The present invention relates to an electric charger device and an image forming device. In particular, the present invention relates to a technology of preventing discharge byproducts, such as ozone and nitrogen oxide ($NO_x$), from being generated as a result of electric discharge.

(2) Related Art

In the field of electronic photography, electric charger devices are conventionally used. A typical electric charger device includes an electric charger element that electrically charges a photoreceptor surface by discharging electrons, before the forming of an electrostatic latent image on the photoreceptor surface.

A material having excellent electron discharge characteristics is suitable for an electric charger element. Materials with a relatively great number of unpaired electrons, which are electrons that are relatively easily released from the molecules of the material, are capable of discharging electrons upon application of a low level of energy (for example, electric field or heat), and thus have excellent electron discharge characteristics.

Recently, research is under way of electric charger devices with electric charger elements made of carbon nanotubes (CNTs). This is since carbon materials, such as diamond and $sp^2$ carbon, have excellent electron discharge characteristics. The term "$sp^2$ carbon" is used to refer to carbon materials in which $sp^2$ carbon molecules are bonded together. The $sp^2$ carbon may be, for example: CNTs; carbon nanohorns; graphene; and graphite.

In the field of electronic photography, corona charger devices are mainstream. For example, Japanese Patent Application Publication No.: 2006-084951 and Japanese Patent Application Publication No.: 2009-251601 disclose corona charger devices including carbon nanotubes. Japanese Patent Application Publication No.: 2006-084951 discloses a corona charger device in which carbon nanotubes are implanted at tips of corona electrode protrusions with comb-teeth shapes or saw-teeth shapes. Japanese Patent Application Publication No.: 2009-251601 discloses a corona charger device in which each corona electrode is composed of one or more carbon nanotube spun yarns.

Also, field emission (FE) charger devices including carbon nanotubes are also proposed. For example, Japanese Patent Application Publication No.: 2002-279885 proposes a FE charger device including an electrically insulative film with microscopic holes, a lead electrode disposed over the microscopic holes, and carbon nanotubes disposed in the microscopic holes. In the FE charger device disclosed in Japanese Patent Application Publication No.: 2002-279885, voltage application to the lead electrode causes the carbon nanotubes to discharge.

As such, there exists conventional technology where carbon nanotubes, which have excellent electron discharge characteristics, are utilized as electric charger elements.

However, even when utilizing carbon nanotubes as electric charger elements, a high voltage of around 1 kV or higher needs to be applied to bring about corona discharge. Thus, corona discharge produces a large amount of discharge byproducts such as ozone and $NO_N$. Similarly, a voltage as high as 1.5 kV needs to be applied to a lead electrode to bring about FE discharge. Thus, FE discharge also produces a large amount of discharge byproducts.

In image forming devices, such discharge byproducts, when generated, may adhere to photoreceptors and other device components, in which case there is a risk of image quality reduction. Further, in order to prevent the spread of such discharge byproducts to the outside, image forming devices are typically provided with filters and the like. However, taking such measures increases device cost.

SUMMARY OF THE INVENTION

In view of such problems, the present disclosure aims to provide an electric charger device and an image forming device that utilize carbon substances, which have excellent electron discharge characteristics as described above, and at the same time generates a reduced amount of discharge byproducts.

In order to achieve this aim, one aspect of the present disclosure is a field effect (FE) electric charger device that electrically charges a surface of a charge-target member, the FE electric charger device including: an electric charger element; a power source supplying the electric charger element with current; and a lead electrode generating an electric field upon voltage application and causing the electric charger element to discharge, wherein the electric charger element has a density no smaller than 0.4 g/cm$^3$, and includes a plurality of filaments each including a plurality of $sp^2$ carbon molecules bonded together.

One aspect of the present disclosure is an image forming device that uniformly charges a photoreceptor surface, generates an electrostatic latent image by exposing the charged photoreceptor surface to light, transfers a toner image yielded by developing the electrostatic latent image onto a recording sheet, and fixes the toner image onto the recording sheet, the image forming device including a field effect (FE) electric charger device that electrically charges a surface of a charge-target member, the FE electric charger device including: an electric charger element; a power source supplying the electric charger element with current; and a lead electrode generating an electric field upon voltage application and causing the electric charger element to discharge, wherein the electric charger element has a density no smaller than 0.4 g/cm$^3$, and includes a plurality of filaments each including a plurality of $sp^2$ carbon molecules bonded together.

BRIEF DESCRIPTION OF THE DRAWINGS

These and other objects, advantages and features of the technology pertaining to the present disclosure will become apparent from the following description thereof taken in conjunction with the accompanying drawings, which illustrate specific embodiment(s) of the technology pertaining to the present disclosure.

In the drawings:

FIG. 7 shows a chart listing characteristics of CNT molecules used in an experiment for evaluating an electric charger element;

FIG. 8 shows a chart listing evaluation results for the electric charger element, configured by using different CNT yarns;

FIG. 9 is a chart listing evaluation results for conventional electric charger devices;

FIG. 13 shows a chart listing evaluation results for the electric charger element, configured by using different CNT sheets.

DESCRIPTION OF PREFERRED EMBODIMENTS

The following provides description of embodiments of the electric charger device and the image forming device pertaining to the present disclosure, with reference to the accompanying drawings.

[1] Embodiment 1

Embodiment 1 describes an image forming device characterized for having an electric charger element including a spun yarn of carbon nanotubes (referred to in the following as a CNT yarn).

(1-1) Image Forming Device Structure

The following describes the structure of the image forming device pertaining to embodiment 1.

Figure 1:
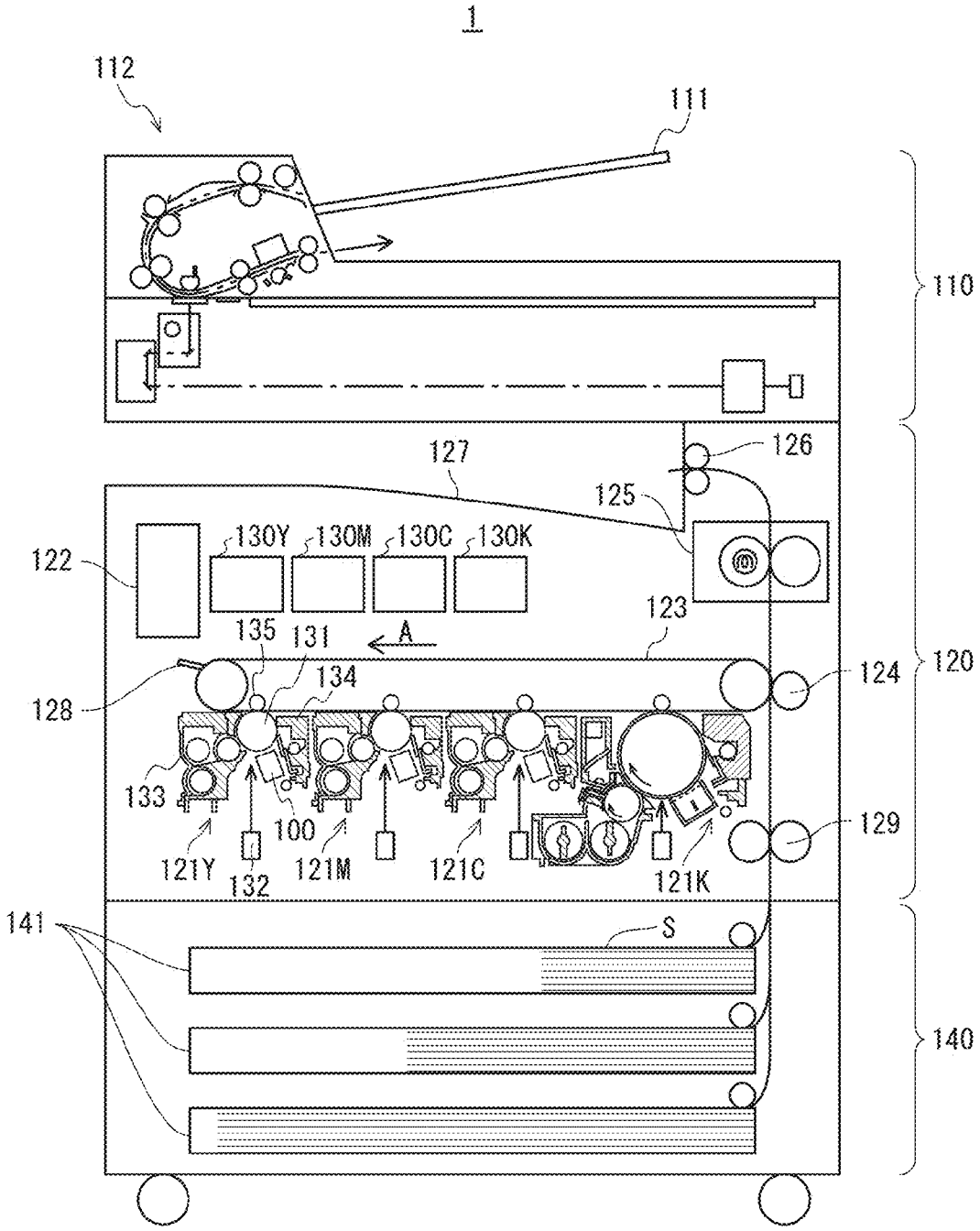
FIG. 1 illustrates main components of an image forming device pertaining to embodiment 1.

FIG. 1 illustrates main components of the image forming device pertaining to embodiment 1. FIG. 1 illustrates an image forming device 1, which is a color multi-function peripheral (MFP) having a so-called tandem system. The image forming device 1 has a document reader 110, an image former 120, and a paper feeder 140. The document reader 110 transports a document placed on a document tray 111 through an automatic document feeder (ADF) 112. Further, while the document is being transported through the ADF 112, the document reader 110 scans the document via optical means to generate image data of the document. The document reader 110 stores the image data so generated to a controller 122, which is described in detail later in the present disclosure.

The image former 120 includes imaging units 121Y, 121M, 121C, and 121K (where the capital letters Y, M, C, and K respectively stand for the colors yellow, magenta, cyan, and black), the controller 122, an intermediate transfer belt 123, a pair of secondary transfer rollers 124, a fixing device 125, a pair of paper eject rollers 126, a paper eject tray 127, a cleaner 128, and a pair of timing rollers 129. Further, the image former 120 has attached thereto toner cartridges 130Y, 130M, 130C, and 130K supplying toner of the respective colors to the image former 120.

The imaging unit 121 of each color forms a toner image of the corresponding color with toner of the corresponding color supplied from the corresponding toner cartridge 130, by being controlled by the controller 122. In the following, description is provided of the operation of the imaging units 121 taking the imaging unit 121Y as an example. However, the following description similarly applies to the rest of the imaging units 121, i.e., the imaging units 121M, 121C, and 121K. The imaging unit 121Y includes a photoreceptor drum 131, an electric charger device 100, a light exposure device 132, a developing device 133, and a cleaning device 134. By being controlled by the controller 122, the electric charger device 100 uniformly charges an outer circumferential surface of the photoreceptor drum 131. The light exposure device 132 exposes the outer circumferential surface of the photoreceptor drum 131 to light based on the image data stored in the controller 122, and thereby forms an electrostatic latent image on the outer circumferential surface of the photoreceptor drum 131.

The developing device 133 develops the electrostatic latent image on the outer circumferential surface of the photoreceptor drum 131 (i.e., forms a toner image) by supplying toner to the outer circumferential surface of the photoreceptor drum 131. The toner image formed on the outer circumferential surface of the photoreceptor drum 131 is electrostatically transferred onto the intermediate transfer belt 123 (primary transfer). Specifically, a primary transfer roller 135, receiving application of a transfer voltage, electrostatically attracts the toner image, whereby the toner image is transferred to the intermediate transfer belt 123. Then, any residual toner remaining on the outer circumferential surface of the photoreceptor drum 131 is scraped away by a cleaning blade of the cleaning device 134.

Similarly, the imaging units 121M, 121C, and 121K respectively form toner images of the colors M, C, and K. Thus, the primary transfer causes toner images of the colors Y, M, C, and K, to overlap one another on the intermediate transfer belt 123. The intermediate transfer belt 123 is an endless rotating belt that rotates in the direction indicated by arrow A in FIG. 1 and thereby transports, to the secondary transfer rollers 124, the toner images having been transferred thereon through the primary transfer.

The paper feeder 140 includes paper cassettes 141 each holding recording sheets S of a corresponding size, and supplies the image former 120 with recording sheets S. Recording sheets S that are supplied to the image former 120 are transported one by one. As the toner images on the intermediate transfer belt 123 are transported to the secondary transfer rollers 124, a recording sheet S is also transported to the secondary transfer rollers 124 via the timing rollers 129. The pair of timing rollers 129 control when the recording sheet S actually arrives at the secondary transfer rollers 124.

The secondary transfer rollers 124 have different electric potentials applied thereto. Further, the secondary transfer rollers 124 press against one another to form a transfer nip. At the transfer nip, the toner images on the intermediate transfer belt 123 are electrostatically transferred onto the recording sheet S (secondary transfer). The recording sheet S carrying a transferred toner image is then transported to the fixing device 125. After the second transfer, any residual toner remaining on the intermediate transfer belt 123 is transported further in the direction indicated by the arrow A, before being discarded by being scraped away by a cleaning blade of the cleaner 128.

The fixing device 125 heats and fuses the toner image having been transferred onto the recording sheet S, and fixes the toner image onto the recording sheet S through application of pressure. Subsequently, the recording sheet S with the toner image heat-fixed thereon is ejected onto the paper eject tray 127 via the paper eject rollers 126. The controller 122 controls the operations of the image forming device 1, which includes an operation panel as well as the components described above. In addition, the controller 122 is also capable of exchanging (transmitting/receiving) image data with and receiving jobs from other devices such as a personal computer (PC).

Note that the transfer of toner images may be achieved by using transfer chargers and transfer belts, instead of transfer rollers. Also, the removal of residual toner on the intermediate transfer belt 123 may be achieved by using a cleaning brush, a cleaning roller, or the like instead of the cleaning blade of the cleaner 128.

(1-2) Structure of Electric Charger Device 100

The following describes the structure of the electric charger device 100.

Figure 2:
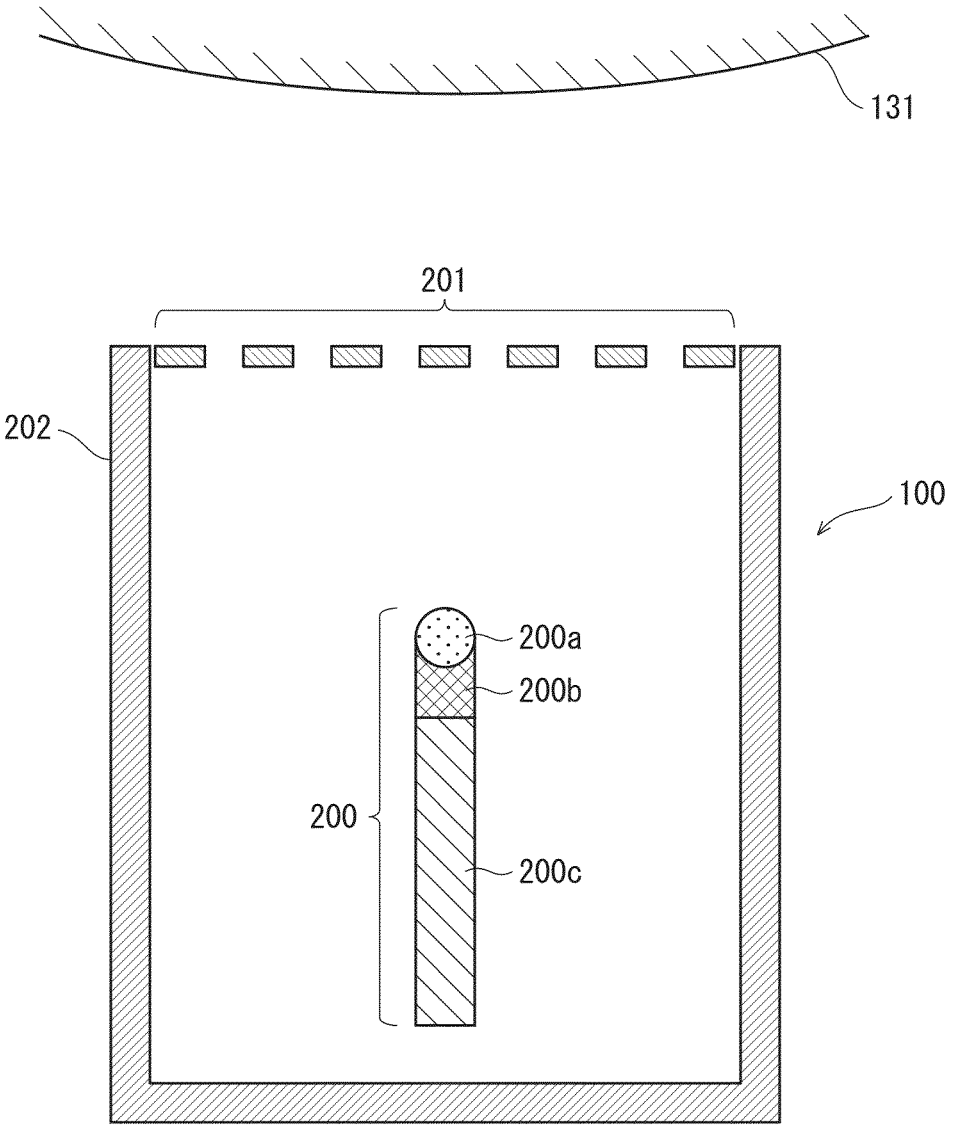
FIG. 2 is a cross-sectional view illustrating the main components of an electric charger device 100.
Figure 3:
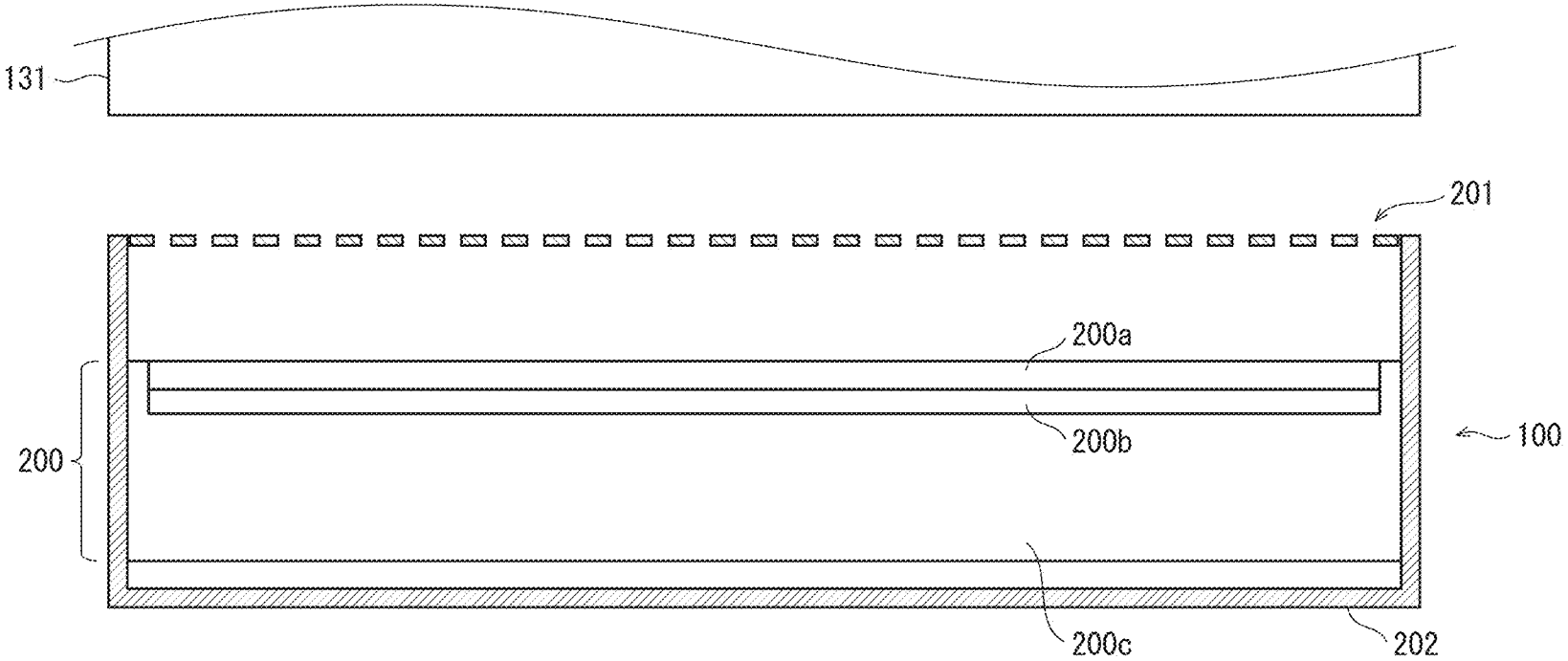
FIG. 3 is a cross-sectional view illustrating the main components of the electric charger device 100.

FIG. 2 is a cross-sectional view illustrating the main components of the electric charger device 100. Specifically, FIG. 2 shows a cross-section taken in a direction perpendicular to a rotation axis of the photoreceptor drum 131. FIG. 3 is also a cross-sectional view illustrating the main components of the electric charger device 100. However, FIG. 3 shows a cross-section taken in a direction parallel to the rotation axis of the photoreceptor drum 131.

The electric charger device 100 is a so-called field effect (FE) charger device. The electric charger device 100 includes an electric charger element 200, a support member 200*c*, a lead electrode 201, and a shielding case 202. The lead electrode 201 is a mesh electrode.

The electric charger element 200 includes a CNT yarn 200*a*, epoxy resin 200*b*, and a support member 200*c*. The CNT yarn 200*a* is fixed to the support member 200*c* via the epoxy resin 200*b*. Further, both ends of the CNT yarn 200*a* are electrically connected to the support member 200*c*. Here, the CNT yarn 200*a* preferably has a diameter no smaller than 30 μm. Meanwhile, while it is possible to use a CNT yarn 200*a* having a diameter no smaller than 120 μm, the CNT yarn 200*a* preferably has a diameter no greater than 120 μm, taking manufacturing time and cost into consideration.

The support member 200*c* is composed of SUS304, which is a type of stainless steel. Thus, the support member 200*c* is electrically conductive. The support member 200*c* receives an electric charger element application current Iem from an undepicted power source and supplies the CNT yarn 200*a* with the electric charger element application current Iem.

Note that a CNT yarn, when coming into contact with oxygen in the atmosphere while being supplied with current, may for example undergo oxidation or combustion, depending upon the current supplied thereto. However, in the electric charger device 100, the CNT yarn 200*a* does not come in contact with oxygen in the atmosphere due to the face of the CNT yarn 200*a* that comes in contact with the support member 200*c* being covered with the epoxy resin 200*b*. As such, the CNT yarn 200*a* has longevity. Further, in the evaluation experiment described later in the present disclosure, degradation of the CNT yarn 200*a*, which may otherwise occur due to for example oxidation or combustion, was not observed.

The lead electrode 201 is a mesh screen electrode composed of SUS304. Specifically, the lead electrode 201 has a wire width of 0.1 mm, and a mesh unit length of 1 mm. Further, the lead electrode 201 is arranged so that the distance between the lead electrode 201 and the electric charger element 200 is within the range of 2 mm to 3 mm, and so that the distance between the lead electrode 201 and the photoreceptor drum 131 is within the range of 3 mm to 5 mm.

When a lead electrode application voltage Vex is applied to the lead electrode 201, an electric field is generated around the electric charger element 200, which causes the electric charger element 200 to discharge electrons. The gaps in the lead electrode 201 guide the electrons so discharged to arrive at the outer circumferential surface of the photoreceptor drum 131. Note that the lead electrode 201 need not be a mesh electrode, and may for example be a grid electrode.

The shielding case 202 is prepared by bending a plate of SUS430 in a U shape. The shielding case 202 surrounds the electric charger element 200 from three sides, while having an opening at a side of the electric charger element 200 that faces the photoreceptor drum 131. The shielding case 202 has a function of stabilizing the electrical field generated around the electric charger element 200 when the lead electrode application voltage Vex is applied to the lead electrode 201, by also receiving application of the lead electrode application voltage Vex. Note that the shielding case 202 need not be composed of SUS430, as long as the shielding case 202 can be processed to have sufficiently accurate dimensions. For example, metal materials other than SUS430 and resin materials such as plastics may be used for forming the shielding case 202.

(1-3) Structure of Electric Charger Element 200

The following describes the structure of the electric charger element 200, or more specifically, the structure of the CNT yarn 200*a*.

The CNT yarn 200*a* is composed of CNT filaments. A CNT filament is composed of CNT molecules bonded together by Van der Waals forces. Here, a CNT molecule is a molecule of $sp^2$ carbon. In the present embodiment, the CNT molecules are multi-walled carbon nanotubes (MWCNT).

MWCNTs include single-walled carbon nanotubes (SWCNTs) disposed concentrically one inside another. Each SWCNT has a structure conceptualized by wrapping a carbon sheet layer of graphite called graphene into a cylinder. MWCNTs are chemically stable, have high mechanical strength, and have excellent electrical conductivity.

(a) CNT Molecules

In the present embodiment, each CNT molecule of a CNT filament has a diameter of approximately 40 nm and a length no smaller than 0.8 mm. CNT molecules having lengths no smaller than 0.8 mm have excellent electron discharge characteristics. Thus, such molecules discharge a sufficient amount of electrons even when the lead electrode application voltage Vex is relatively low. This is described in detail later in the present disclosure. Accordingly, the use of such CNT molecules reduces the generation amount of discharge byproducts.

Meanwhile, the "Stanton-Pott hypothesis" reports that fibers with a diameter between 0.031 μm and 2 μm, inclusive, and a length between 1.25 μm and 40 μm, inclusive, may be harmful, for example, for being carcinogenic. This hypothesis further reports that fibers with a diameter of around 0.25 μm and a length of around 20 μm may be particularly harmful. In this sense, the present embodiment, which utilizes CNT molecules having a length no smaller than 0.8 mm, is exempt from such health risks.

Figure 4:
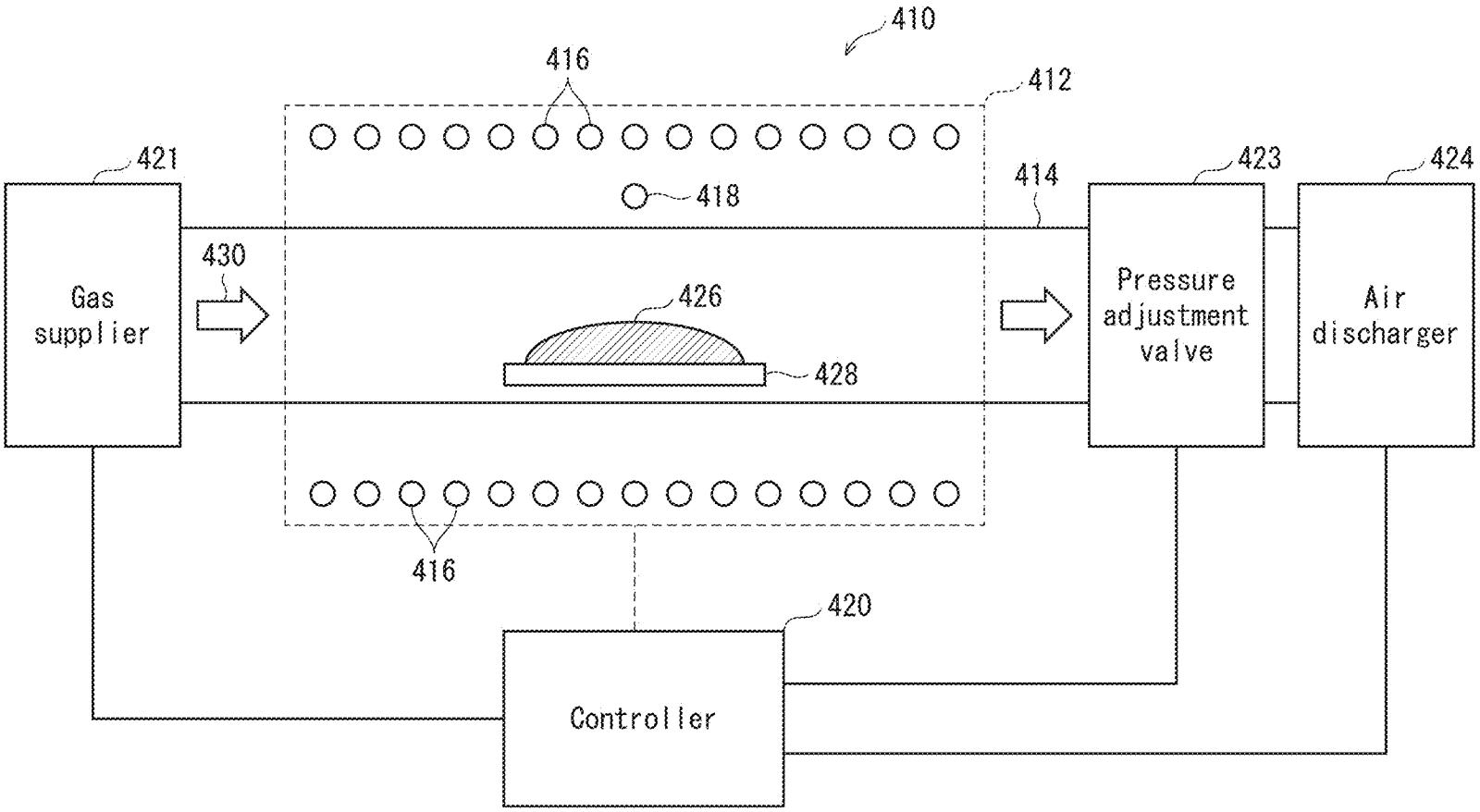
FIG. 4 provides an overview of a device for producing CNT molecules.

The CNT molecules pertaining to the present embodiment may, for example, be produced by using the methods disclosed in Japanese Patent Application Publication No.: 2009-196873 and Japanese Patent Application Publication No.: 2013-216578. FIG. 4 provides an overview of a device for producing CNT molecules by using a conventional method. FIG. 4 illustrates a chemical vapor deposition (CVD) device 410. The CVD device 410 has an electric furnace 412, and a quartz tube 414 inserted through the electric furnace 412. In addition, the CVD device 410 includes heaters 416 and a thermocouple 418 disposed around the quartz tube 414.

Further, the CVD device 410 includes a gas supplier 421 connected to one end of the quartz tube 414, and a combination of a pressure adjustment valve 423 and an air discharger 424 connected to the other end of the quartz tube 414. Further, the CVD device 410 has a controller 420. The controller 420 controls the air discharger 424 to create a vacuum inside the quartz tube 414, and controls the heaters 416 to heat the inside of the quartz tube 414 to reach a temperature causing a catalyst 426 to sublimate. Further, after the quartz tube 414 has been put in such a condition, the controller 420 controls the gas supplier 421 to introduce acetylene gas 430 into the quartz tube 414.

This results in a gas phase reaction occurring between the catalyst 426 and the acetylene gas 430. This bears CNT molecules on a quartz substrate 428 placed inside the quartz tube 414. Specifically, the CNT molecules grow to extend in the perpendicular direction from the surface of the quartz substrate 428. Note that the catalyst 426 is iron chloride, and contains at least one of ferric chloride and ferrous chloride.

(b) CNT Filaments

Each CNT filament is composed of CNT molecules connecting with one another in both the vertical and horizontal directions due to Van der Waals forces. Each CNT filament preferably has a diameter no smaller than 40 nm and no greater than 400 nm. The use of CNT filaments having diameters greater than 400 nm tends to decrease the density and the electron discharge characteristics of the CNT yarn 200*a* and increase the amount of discharge byproducts generated.

For example, CNT filaments may be produced according to the method disclosed in "Continuous Dry-Spinning for Carbon Nanotube Yarn", Yoku INOUE, Journal of the Imaging Society of Japan, Vol. 53, No. 1, pages 71-76, 2014. Specifically, this document discloses producing CNT filaments by using dry-spinning and sequentially pulling out the CNT molecules extending in the perpendicular direction on the quartz substrate 428. This method produces CNT filaments having diameters in accordance with the applied pulling speed, due to CNT molecules sliding with respect to one another along the length direction and connecting. In the CNT filaments so formed, the CNT molecules form strong bonds due to strong Van der Waals forces. Thus, the CNT filaments may be used in electric charger elements, without performing spinning as described in the following.

(c) CNT Yarn 200*a*

Figure 5A:
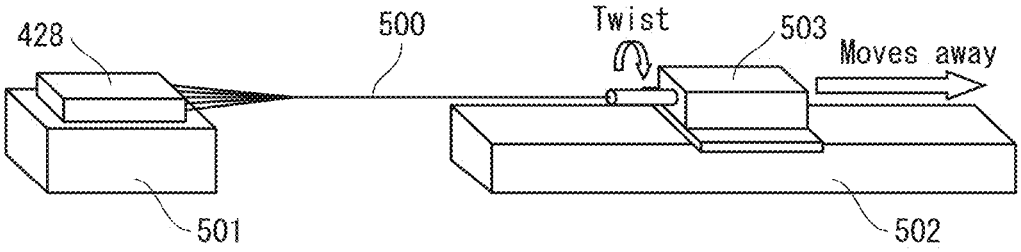
FIGS. 5A and 5B provide an overview of a device for manufacturing a CNT yarn, with FIG. 5A illustrating a device for manufacturing a low twist CNT yarn and FIG. 5B illustrating a device for fabricating a two-ply CNT yarn.

The CNT yarn 200*a* is fabricated by spinning a plurality of CNT filaments into a thread. In this process, for example, a desktop spinning system can be used, as disclosed in "Continuous Dry-Spinning for Carbon Nanotube Yarn", Yoku INOUE, Journal of the Imaging Society of Japan, Vol. 53, No. 1, pages 71-76, 2014. FIG. 5A illustrates one example of such a desktop spinning system. The desktop spinning system illustrated in FIG. 5A includes a stationary mount 501 on which the quartz substrate 428 is placed, a spindle 503, and a movable mount 502 on which the spindle 503 is installed. Using this system, a CNT yarn (indicated by reference symbol "500" in FIG. 5A) can be fabricated by moving the movable mount 502 away from the stationary mount 501 while causing the spindle 503 to rotate. Specifically, according to this method, multiple CNT filaments drawn out from the quartz substrate 428 are twisted together.

Here, the CNT yarn 500 being fabricated can be provided with a predetermined density by controlling the twisting rate of the spindle 503, and the pulling speed at which the CNT yarn 500 is drawn out from the quartz substrate 428. To provide a typical example, the twisting rate is 32,000 rpm (revolutions per minute), and the pulling speed is 120 mm/second. This example produces a CNT yarn 500 having a twist angle of around 25°, when the CNT filaments have a diameter of 5 mm.

Figure 5B:
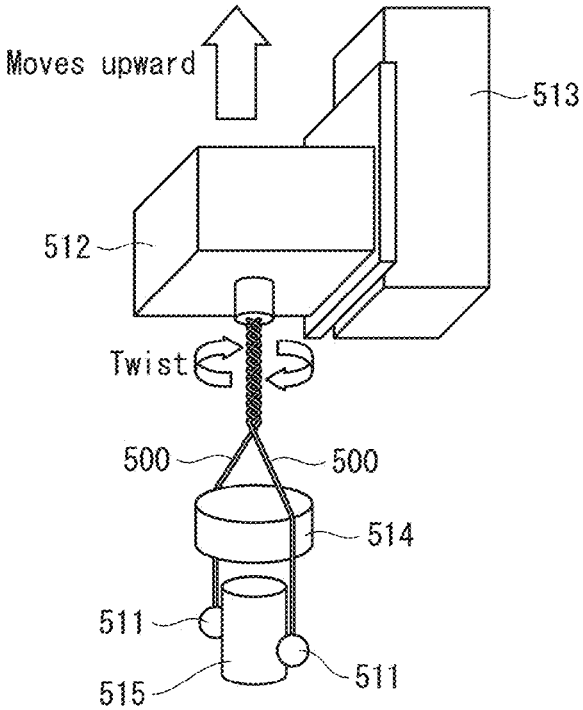

Alternatively, the CNT yarn 200*a* may be fabricated by spinning multiple low twist CNT yarns into a single CNT yarn. In this case, as illustrated in FIG. 5B, multiple low twist CNT yarns (indicated by reference symbol "500" in FIG. 5B) are prepared, and a weight 511 is fixed to one end of each CNT yarn 500. Further, the other end of each CNT yarn 500 is fixed to a vertical spindle 512. The vertical spindle 512 is attached to a movable mount 513 that is capable of sliding vertically upwards. Further, guides 514 and 515 are provided, in order to prevent the CNT yarns 500 from entangling with one another.

As the movable mount 513 slides upwards, the spindle 512 also moves upwards. While moving upwards, the spindle 512 spins the CNT yarns 500 into a single thread. To provide a typical example, the spinning rate of the spindle 512 is 240 rpm, and pulling speed is 1 mm/second. In this case, the heavier the weights 511, the greater the weight density, the tensile strength, and the Young's modulus of the CNT yarn 200*a* fabricated.

Figure 6:
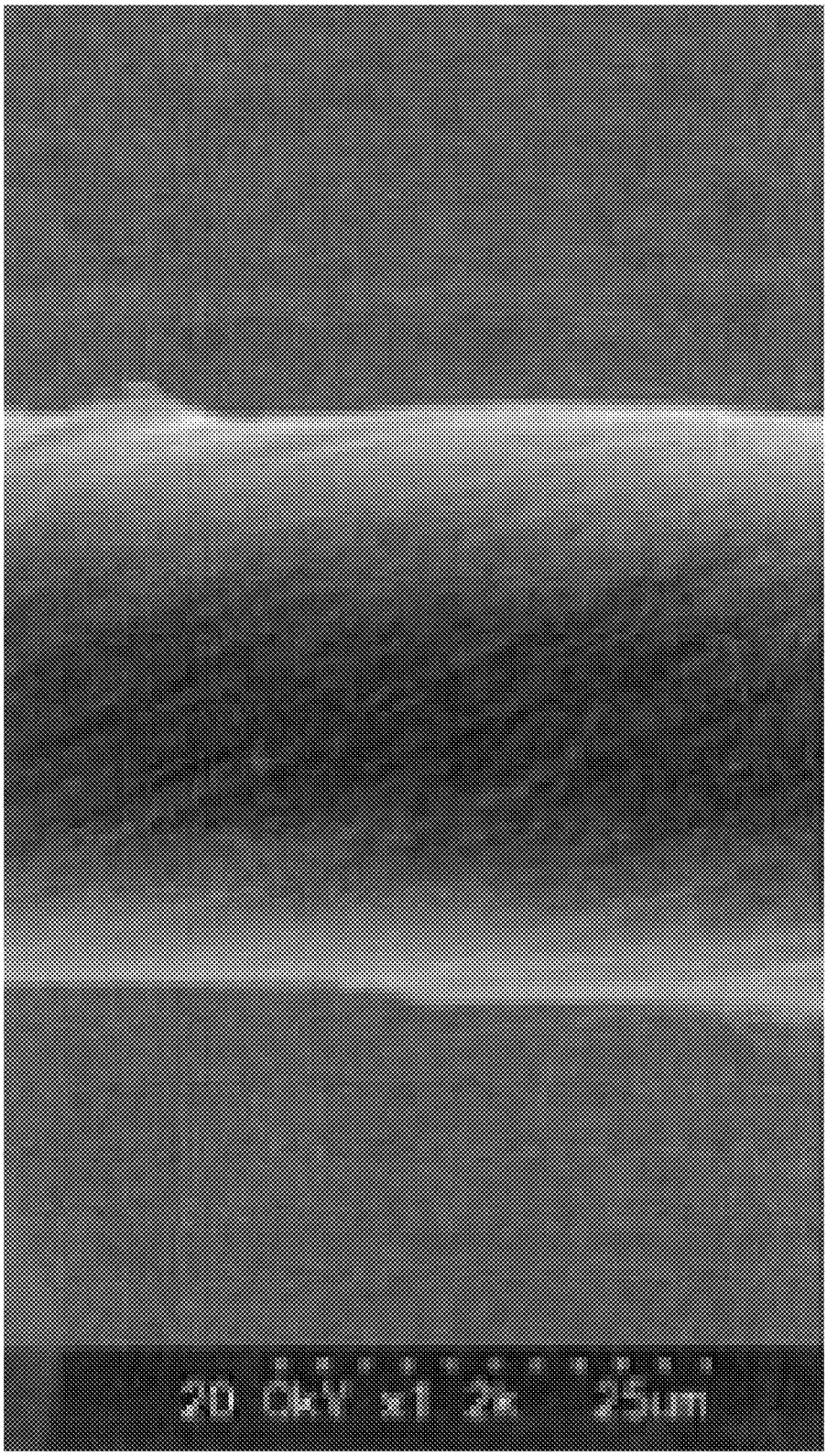
FIG. 6 shows an electronic microscope photograph of the CNT yarn.

FIG. 6 shows a photograph of the CNT yarn 200*a*, taken by using scanning electron microscopy (SEM). FIG. 6 shows that the CNT yarn 200*a* is composed of a plurality of CNT filaments spun together.

Further, the CNT yarn 200*a* has a substantially circular cross-section, and thus, the diameter of the CNT yarn 200*a* can be measured from the SEM photograph. In addition, the density of the CNT yarn 200*a* can be calculated by measuring the length and the weight of the CNT yarn 200*a*. Fabrication of a CNT yarn having a density between 0.4 $g/cm^3$ and 1.6 $g/cm^3$ is relatively easy. The same applies to the later-described CNT sheet.

Both the CNT yarn 200*a* and the later-described CNT sheet are composed of a plurality of CNT filaments, each having loose ends sticking out from the CNT yarn 200*a*/CNT sheet like whiskers. Ends of CNT filaments correspond to ends of CNT molecules. Typically, a presumption is made that upon lead electrode voltage application, such ends of CNT molecules discharge electrons.

(1-4) Characteristics of Electric Charger Element 200

The following describes results of an evaluation experiment that the present inventor conducted by using various CNT yarns 200*a*, to specify conditions providing electric charger elements 200 with desirable characteristics. Specifically, in the experiment, the present inventor measured the electron discharge characteristics and the ozone generation amount of the electric charger element 200, when configured by using different CNT yarns 200*a*.

(a) CNT Molecules

For the experiment, a plurality of CNT yarns 200*a* were prepared. Each CNT yarn 200*a* was composed of one of four different types of CNT molecules (namely CNT1, CNT2, CNT3, and CNT4), each having a different length. As illustrated in FIG. 7, these CNT molecules were prepared by varying acetylene gas flow amount and CVD condition. This resulted in the CNT molecules having different lengths within the range of 0.5 mm and 2.1 mm, inclusive. Meanwhile, the CNT molecules had the same diameter of 40 nm.

Note that the diameter and the length of each CNT molecule were measured by forming an array of the CNT molecule on the quartz substrate 428 and observing the array by using SEM.

(b) Experiment Equipment

The measurement of electron discharge characteristics of the electric charger element 200, configured by using the different CNT yarns 200*a*, was performed by removing an imaging unit 121 from the image forming device 1, setting the imaging unit 121 onto a jig for measuring the electrical potential of the outer circumferential surface of the photoreceptor drum 131 (referred to in the following as a photoreceptor surface potential V0), gradually increasing the lead electrode application voltage Vex and the electric charger element application current Iem from the external power source, and measuring the lead electrode application voltage Vex and the electric charger element application current Iem achieving a photoreceptor surface potential V0 within the range of −500 V±5 V, as well as the specific photoreceptor surface potential V0. Note that the measurement was performed under an ambient temperature within the range of 23° C.±2° C. and relative humidity within the range of 60%±5%.

Note that an electric charger element application voltage Vem (i.e., voltage applied to the electric charger element 200) was also measured. However, the electric charger element application voltage Vem was substantially equal to the lead electrode application voltage Vex. Further, the imaging unit 121 used in the experiment was prepared, in specific, by attaching the electric charger device 100 pertaining to the present embodiment to a Bizhub 554*e* drum cartridge ("Bizhub" is a registered trademark of Konica Minolta, Inc.).

Further, the measurement of ozone generation amount of the electric charger element 200, configured by using the different CNT yarns 200*a*, was performed by placing the image forming device 1 in a chamber with an internal volume of 2.1 $m^3$, causing the image forming device 1 to continuously print halftone images with a black-to-white ratio of 10%, and measuring average ozone density within a ten-minute period by using a Model-1200 ozone analyzer manufactured by Dylec Inc. Specifically, the measurement was performed with the internal volume of the chamber controlled to have a temperature within the range of 23° C.±2° C. and relative humidity within the range of 60%±5%. Further, the ten-minute period was measured starting from thirty minutes after completion of the operation of the image forming device 1. Further, the image forming device 1 used in this measurement was prepared, in specific, by attaching the electric charger device 100 pertaining to the present embodiment to a Bizhub 554*e* drum cartridge ("Bizhub" is a registered trademark of Konica Minolta, Inc.), and removing any pre-installed ozone filter.

As described above, in the present experiment, the electron discharge characteristics and the ozone generation amount of the electric charger element 200, configured by using the different CNT yarns 200*a*, were measured. In addition, for each of the CNY yarns 200*a*, the diameter and the density of the CNT yarn 200*a*, and the diameters of the CNT filaments composing the CNT yarn 200*a* were also measured in the present experiment.

The measurement of CNT filament diameters and CNT yarn diameter was performed by SEM observation. Further, the density of each CNT yarn 200*a* was calculated by first measuring the weight of the CNT yarn 200*a* by using a microbalance, and then calculating cross-sectional area and volume of the CNT yarn 200*a* according to the diameter of the CNT yarn 200*a*, acquired through the SEM observation, a length of the CNT yarn 200*a* measured by using a scale.

Further in addition, quantitative and qualitative analysis of CNT yarn carbon purity was performed through SEM-EDX analysis, which involves the use of both SEM and energy dispersive X-ray spectroscopy (EDX).

(c) Comparative Experiment

As a comparative experiment, the present inventor measured electric discharge characteristics and ozone generation amounts of conventional electric charger devices.

The present inventor conducted the comparative experiment by using two types of conventional electric charger devices, one being a scorotron charger device that is one type of a corona charger device, and a roller charger device.

Corona charger devices, such as corotron charger devices and scorotron charger devices, typically generate corona discharge by using electric fields strong enough to bring about electrical breakdown even under atmospheric pressure. Thus, corona charger devices typically generate a large amount of discharge byproducts, such as ozone and $NO_x$. Further, corona charger devices typically require a high voltage power source supplying 4 kV to 6 kV voltage, and thus are inefficient in terms of cost and energy conservation.

Meanwhile, a roller charger device includes a charge roller made of electrically conductive rubber, and electrically-charges a photoreceptor surface by inducing electric discharge within an extremely small gap formed between the charge roller and the photoreceptor surface when the charge roller is put in contact with the photoreceptor surface. The amount of ozone generated by a roller charger device is about one hundredth of that generated by a corona charger device. However, roller charger devices do have certain drawbacks. Typically, there are two methods being used for applying voltage to a charge roller in a roller charger device. In one method (direct application), the charge roller receives application of only a direct current voltage, whereas in the other method (superimposed application), the charge roller receives application of a direct current voltage and in addition, an alternating current voltage superimposed onto the direct current voltage. Here, it should be noted that the direct application method poses a problem that the photoreceptor surface cannot be uniformly charged (i.e., charge unevenness occurs at the photoreceptor surface). The charge unevenness is brought about, for example, by unevenness in contact between the charge roller and the photoreceptor and/or unevenness of resistance of the charge roller surface. Meanwhile, such charge unevenness is not seen with the superimposed application method. However, the superimposed application method is problematic for generating a greater amount of ozone than the direct application method.

The scorotron charger device used in the comparative experiment included a casing having an opening facing the photoreceptor drum, a corona electrode disposed within the casing, and a grid electrode disposed at the opening of the casing. In the comparative experiment, with this scorotron charger device, a grid electrode voltage Vg, a corona electrode voltage Vc, and a corona electrode current application amount k required to uniformly charge the outer circumferential surface of the photoreceptor drum to have a potential within the range of −500 V±5 V were measured. Further, with the roller charger device, a charge roller application voltage Vc required to uniformly charge the outer circumferential surface of the photoreceptor drum to have a potential within the range of −500 V±5 V was measured.

(d) Experiment Results

Specifically, the experiment with the different CNT yarns 200*a* was performed by using eight different CNT yarns 200*a*, each corresponding to a different one of eight conditions, namely conditions HC1 through HC8, as illustrated in FIG. 8. With conditions HC1 through HC6, it was possible to substantially uniformly charge the outer circumferential surface of the photoreceptor drum 131 to have a potential V0 within the range of −500 V±5 V with a low lead electrode application voltage Vex of −600 V. Further, the ozone generation amounts for conditions HC1 through HC6 were no greater than 0.01 ppm, and were relatively small amounts making ozone filters unnecessary. Based on this, the present inventor made a presumption that the CNT yarns 200*a* corresponding to these conditions also reduce the generation amount of discharge byproducts other than ozone.

Meanwhile, the comparative experiment revealed that the conventional electric charger devices require application of high voltage. This can be seen from FIG. 9, where it is shown that the difference between the grid electrode voltage Vg and the corona electrode voltage Vc was no smaller than −1 kV with the scorotron charger device, and the charge roller application voltage Vc required for substantially uniformly charging the outer circumferential surface of the photoreceptor drum to have a potential within the range of −500 V±5 V was no smaller than −1 kV with the roller charger device. Further, the ozone generation amounts of the conventional electric charger devices were at least 0.01 ppm, and were relatively great amounts.

Returning to FIG. 8, condition HC7 corresponds to a low twist CNT yarn 200*a*. Generally, a low twist CNT yarn has relatively small diameter and density, and thus is brittle. For condition HC7, the present inventor was not able to perform the evaluation of electron discharge characteristics, ozone generation amount, etc. This is since assembling the electric charger device 200 with the low twist CNT yarn 200*a* was difficult in the first place, and even when the present inventor succeeded in assembling the electric charger device 200 with the low twist yarn 200*a*, the low twist CNT yarn 200*a* for example snapped when attempting to apply the electric charger element application current Tem.

Based on this, a presumption can be made that the use a CNT yarn 200*a* having a diameter of no greater than 15 μm and/or a density no greater than 0.35 g/cm$^3$ in the electric charger element 200 is difficult. Further, based on the experiment results for conditions HC1 through HC6, a presumption can be made that a CNT yarn 200*a* having a diameter no smaller than 30 μm and a density no smaller than 0.4 g/cm$^3$ is preferable for use in the electric charger element 200.

Meanwhile, condition HC8 corresponds to a CNT yarn 200*a* that was composed of CNT molecules with short length (CNT4 illustrated in FIG. 7), that was composed of CNT filaments with relatively great diameters reaching 450 nm, and that had a low density of 0.30 g/cm$^3$. With this CNT yarn 200*a*, while the necessary electric charger element application current Tem, at −200 μA, was relatively higher than those for conditions HC1 through HC6, it was still possible to uniformly charge the outer circumferential surface of the photoreceptor drum 131 with a potential V0 within the range of −500 V±5 V.

Further, while the ozone generation amount with this CNT yarn 200*a*, at 0.02 ppm, was relatively greater than those for conditions HC1 through HC6, the ozone generation amount was still an amount making ozone filters unnecessary.

However, the CNT yarn 200*a* corresponding to condition HC8 snapped when image forming was performed continuously for ten to fifteen minutes after completion of the measurement of electron discharge characteristics, ozone generation amount, etc. A presumption is made that this was due to the low density of the CNT yarn 200*a*. Specifically, a presumption is made that with a CNT yarn 200*a* that is composed of CNT molecules with short length and that has low density, continuous application of the electric charger element application current Tem causes loosening of the bonds formed by the CNT molecules therein and consequent causes the CNT yarn 200*a* to snap. Needless to say, when the CNT yarn 200*a* has snapped, the electric charger element 200 is no longer capable of performing electric discharge.

As such, it is preferable that the electric charger element 200 include a CNT yarn 200*a* having a density no smaller than 0.4 g/cm$^3$ and a diameter no smaller than 30 μm and no greater than 120 μm. Further, it is preferable that the electric charger element 200 include a CNT yarn 200*a* that is composed of CNT filaments having a diameter no smaller than 40 nm and no greater than 400 nm, and that is composed of CNT molecules having a length no smaller than 0.8 mm and no greater than 2.1 mm.

With such an electric charger element 200, the absolute value of the lead electrode application voltage Vex can be limited to 1 kV or smaller, and thus the generation amount of discharge byproducts, such as ozone, can be reduced. This eliminates the necessity of providing an ozone filter to the image forming device 1, and also increases the durability of the electric charger element 200 including the CNT yarn 200*a*.

[2] Embodiment 2

Embodiment 2 describes an image forming device that has a structure generally similar to the structure of the image forming device pertaining to embodiment 1. However, the image forming device pertaining to embodiment 2 differs from the image forming device pertaining to embodiment 1 for the electric charger element including a carbon nanotube sheet (referred to as a CNT sheet in the following) in place of a CNT yarn. The following description focuses on differences between embodiments 1 and 2. Note that components already described in embodiment 1 are referred to by using the same reference numerals/reference signs in embodiment 2.

(2-1) Structure of Electric Charger Device 100

The following describes the structure of the electric charger device 100 in embodiment 2.

Figure 10:
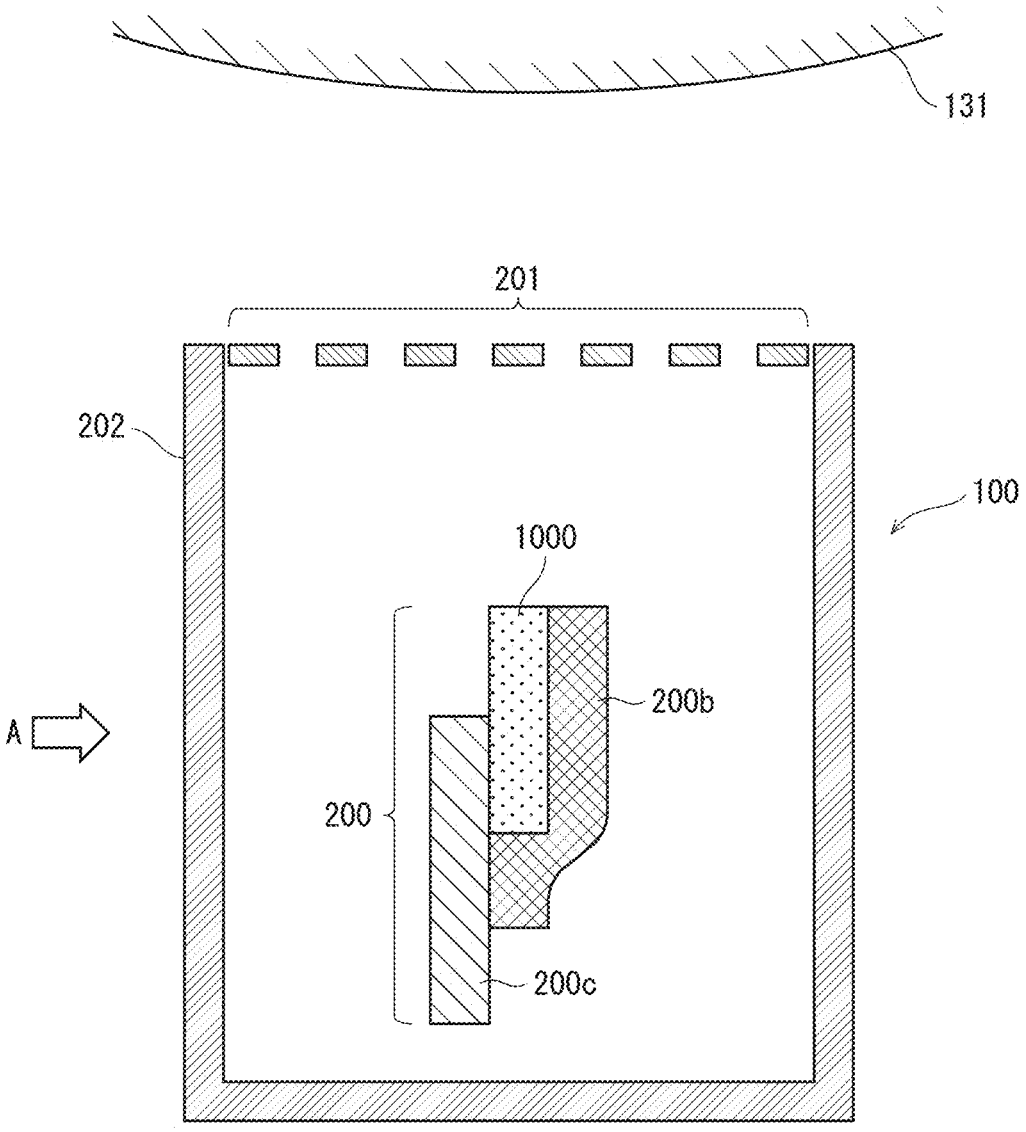
FIG. 10 is a cross-sectional view illustrating the main components of the electric charger device 100 in embodiment 2.
Figure 11:
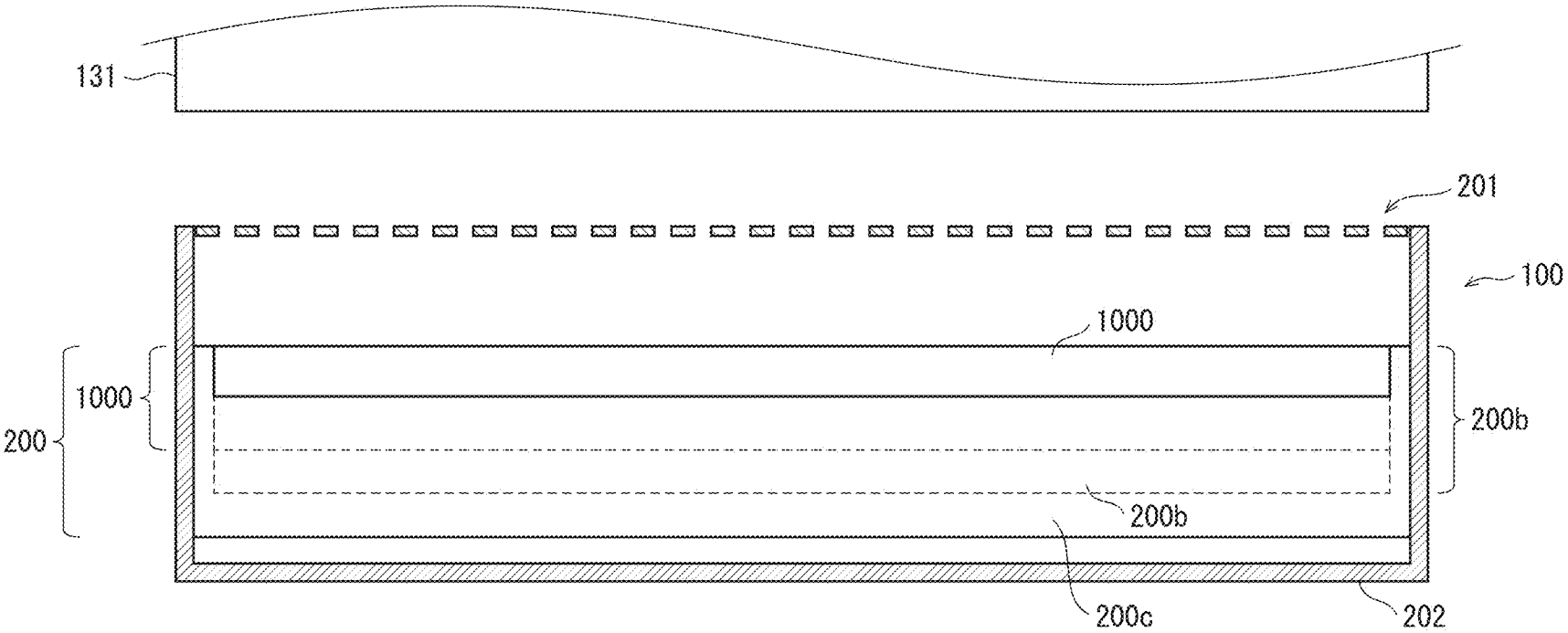
FIG. 11 is a cross-sectional view illustrating the main components of the electric charger device 100 in embodiment 2.

FIG. 10 is a cross-sectional view illustrating the main components of the electric charger device 100 in embodiment 2. Specifically, FIG. 10 shows a cross-section taken in a direction perpendicular to the rotation axis of the photoreceptor drum 131. FIG. 11 is also a cross-sectional view illustrating the main components of the electric charger device 100 in embodiment 2. However, FIG. 11 shows a cross-section taken in a direction parallel to the rotation axis of the photoreceptor drum 131 and from a direction indicated by arrow A in FIG. 10.

The electric charger element 200 in embodiment 2 includes a CNT sheet 1000, the epoxy resin 200*b*, and the support member 200*c*. The CNT sheet 1000 is adhered to the support member 200*c* via the epoxy resin 200*b*, and is electrically connected to the support member 200*c*. Further, the lead electrode 201 is arranged so that the distance between the lead electrode 201 and a leading edge of the CNT sheet 1000 is within the range of 2 mm to 3 mm.

In assembling the electric charger element 200, first, an epoxy adhesive is applied to cover the CNT sheet 1000, and then the epoxy adhesive is cured. This yields the epoxy resin 200*b*. Further, a leading portion of the epoxy resin 200*b* that faces the photoreceptor drum 131 is cut off, whereby an end portion of the CNT sheet 1000 is exposed from the epoxy resin 200*b*. When caused to discharge, the CNT sheet 1000 discharges electrons from this exposed portion.

Embodiment 2 is similar to embodiment 1 in that the CNT sheet 1000 does not come in contact with oxygen in the atmosphere due to being covered with the epoxy resin 200*b*. As such, the CNT sheet 1000 has longevity. Further, in the evaluation experiment described later in the present disclosure, degradation of the CNT sheet 1000, which may otherwise occur due to for example oxidation or combustion, was not observed.

(2-2) Structure of Electric Charger Element 200

The following describes the structure of the electric charger element 200 in embodiment 2, or more specifically, the structure of the CNT sheet 1000.

The CNT sheet 1000 is fabricated by using a CNT sheet winding machine manufactured by Hamamatsu Carbonics Corporation. The CNT sheet winding machine is capable of fabricating the CNT sheet 1000 from CNT molecules that have grown to extend in the perpendicular direction from the quartz substrate 428.

The CNT sheet winding machine has multiple operations modes, including the "Sheet Mode" and the "Tape Mode", and a suitable operation mode can be selected depending upon the desired shape of the CNT sheet 1000. Further, weight of the CNT sheet 1000 per unit area can be specified by selecting the number of layers.

Figure 12:
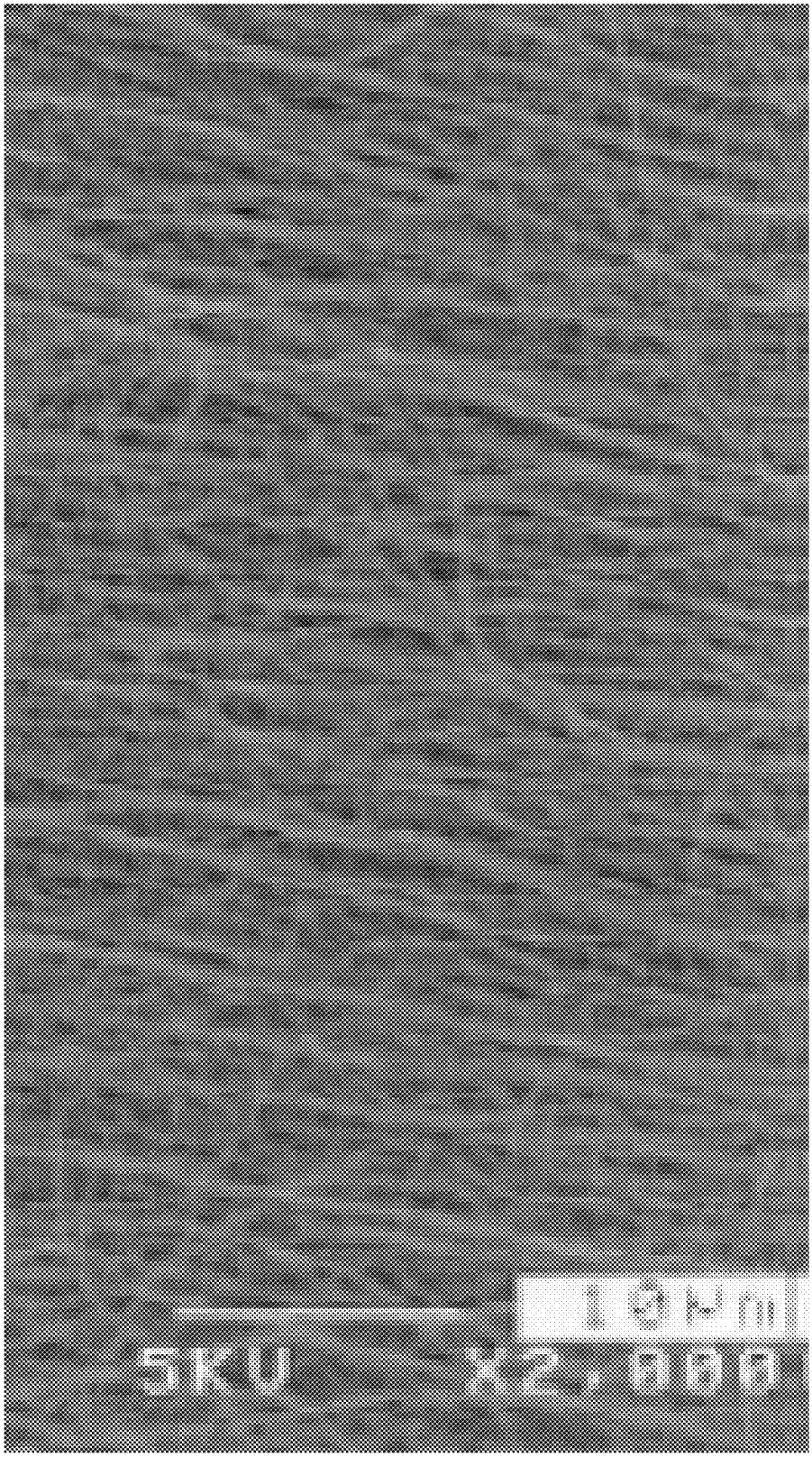
FIG. 12 shows an electronic microscope photograph of a CNT sheet.

FIG. 12 shows a SEM photograph of the CNT sheet 1000. FIG. 12 shows orientations of the CNT filaments in the CNT sheet 1000.

(2-3) Characteristics of Electric Charger Element 200

The following describes results of an evaluation experiment that the present inventor conducted by using various CNT sheets 1000. Specifically, in the experiment, the present inventor measured the electron discharge characteristics and the ozone generation amount of the electric charger element 200, when configured by using different CNT sheets 1000.

In the experiment, the present inventor used CNT molecules CNT2 and CNT4 among the CNT molecules shown in FIG. 7, and prepared CNT sheets 1000 by using these CNT molecules. Further, the equipment used in this experiment was generally the same as the equipment used in the experiment in embodiment 1. Thus, the experiment in the present embodiment differs from the experiment in embodiment 1 for the electric charger element 200 being configured by using different CNT sheets 1000.

The results of the experiment are provided in the following.

As illustrated in FIG. 13, the experiment was conducted by using two different CNT sheets 1000, each corresponding to one of two conditions, namely condition HC11 and condition HC12. With condition HC11, it was possible to substantially uniformly charge the outer circumferential surface of the photoreceptor drum 131 with a low lead electrode application voltage Vex of −600 V. Further, the ozone generation amount for condition HC11 was 0.005 ppm. Based on this, the present inventor made a presumption that the CNT sheet 1000 corresponding to condition HC11 generates a reduced amount of discharge byproducts.

Meanwhile, condition HC12 corresponds to a CNT sheet 1000 that was composed of CNT molecules with short length, that was composed of CNT filaments with relatively great diameters reaching 450 nm, and that had a low density of 0.25 g/cm$^3$. With this CNT sheet 1000, while the necessary electric charger element application current Iem, at −200 μA, was relatively higher than that for condition HC11, it was still possible to uniformly charge the outer circumferential surface of the photoreceptor drum 131.

Further, while the ozone generation amount with this CNT sheet 1000, at 0.02 ppm, was relatively higher than that for condition HC11, the ozone generation amount was still an amount making ozone filters unnecessary.

However, a partial tear was observed in the CNT sheet 1000 corresponding to condition HC12 after continuous image forming was performed, similar to condition HC8 in embodiment 1. A presumption is made that the partial tear occurred due to the same reasons as the reason why the CNT yarn 200*a* corresponding to condition HC8 snapped. When the CNT sheet 1000 has torn, the electric charger element 200 is no longer capable of uniformly charging the outer circumferential surface of the photoreceptor drum 131.

Taking into consideration the experiment results in the present embodiment and the experiment results in embodiment 1, it is preferable that the electric charger element 200 include a CNT sheet 1000 having a density no smaller than 0.4 g/cm$^3$. Further, it is preferable that the electric charger element 200 include a CNT sheet 1000 that is composed of CNT filaments having a diameter no smaller than 40 nm and no greater than 400 nm, and that is composed of CNT molecules having a length no smaller than 0.8 mm and no greater than 2.1 mm.

With such an electric charger element 200, the absolute value of the lead electrode application voltage Vex can be limited to 1 kV or smaller, and thus the generation amount of discharge byproducts, such as ozone, can be reduced. This also increases the durability of the electric charger device 200 including the CNT sheet 1000.

[3] Modifications

Up to this point, description has been provided of the technology pertaining to the present disclosure based on embodiments thereof. However, the technology pertaining to the present disclosure shall not be construed as being limited to such embodiments, and modifications such as those described in the following may be made.

(1) In the embodiments, the electric charger element 200 utilizes carbon nanotubes. However, the electric charger element 200 need not utilize carbon nanotubes, and for example may utilize, in place of carbon nanotubes, other types of sp$^2$ carbon such as carbon nanohorns, graphene, and graphite, or diamond.

In any case, a material having excellent electron discharge characteristics is suitable for the electric charger element 200. Materials with a relatively great number of unpaired electrons, which are electrons that are relatively easily released from the molecules of the material, are capable of discharging electrons upon application of a low level of energy (for example, electric field or heat), and thus have excellent electron discharge characteristics.

Typical electric charger elements utilize materials having low work functions, and more particularly, materials having work functions no greater than 5 eV. Note that when a material has a low work function, the material has good electron discharge characteristics. Meanwhile, $sp^2$ carbons described above are composed of only carbon atoms, and thus have a work function between 4 eV and 5 eV, which is not particularly low in view of other electron discharge materials.

Nevertheless, $sp^2$ carbons, due to having unique structures (e.g., high aspect ratio, which is the ratio of molecule length to molecule diameter, and extremely small, nanometer-order electron discharge portions) not seen in other electron discharge materials, have high electron discharge characteristics. Due to this, by using $sp^2$ carbon in the electric charger element 200, the necessary lead electrode application voltage Vex can be reduced, and thus the generation amount of discharge byproducts can be reduced.

(2) In the embodiments, the electric charger element 200 includes either a CNT yarn 200*a* or a CNT sheet 1000. However, the electric charger element 200 need not include a CNT yarn 200*a* or a CNT sheet 1000, and for example may include a different shaped structure composed of carbon nanotubes. For example, the electric charger element 200 may include a brush-like structure composed of carbon nanotubes, or may include a three-dimensional, felt-like structure composed of carbon nanotubes.

(3) In the embodiments, the CNT yarn 200*a*/CNT sheet 1000 is attached to the support member 200*c* by using an epoxy adhesive. However, the CNT yarn 200*a*/CNT sheet 1000 need not be attached to the support member 200*c* by using an epoxy adhesive. For example, the CNT yarn 200*a*/CNT sheet 1000 may be attached to the support member 200*c* by first fixing the CNT yarn 200*a*/CNT sheet 1000 to the support member 200*c* and then covering the CNT yarn 200*a*/CNT sheet 1000 so fixed by using an electrically-insulative tape such as a polyimide tape or a fluororesin tape, instead of an epoxy adhesive.

Here, it should be noted that depending upon current application conditions such as applied current and period of use, the bonds between the CNT molecules composing the CNT yarn 200*a*/CNT sheet 1000, formed by Van der Waals forces, may break, which results in loosening of the CNT yarn 200*a*/CNT sheet 1000. This may further result in problems such as snapping of the CNT yarn 200*a* and partial tearing of the CNT sheet 1000.

Such problems can be prevented by covering the CNT yarn 200*a*/CNT sheet 1000 as described above. Specifically, by covering the CNT yarn 200*a*/CNT sheet 1000 as described above, snapping of the CNT yarn 200*a* and partial tearing of the CNT sheet 1000 can be prevented, which achieves longevity of the electric charger element 200.

However, in certain situations, the CNT yarn 200*a* may be disposed to span across the support member 200*c* in tensioned state by only both ends of the CNT yarn 200*a* being adhered and fixed to the support member 200*c*, without covering the CNT yarn 200*a* as described above. Such situations include: (i) when the electric charger element 200 need not have longevity due to the image forming device 1 being a lost cost model; and (ii) when a low oxygen or zero oxygen state as described in the following is formed around the electric charger element 200.

(4) In the embodiments, air can enter/exit the electric charger device 100 via the gaps in the lead electrode 201. However, the electric charger device 100 need not be configured in such a manner, and for example, the electric charger device 100 may be configured so that the shielding case 202 is airtight and the lead electrode is replaced with a film allowing electrons discharged from the electric charger element 200 to pass therethrough but not allowing any oxygen molecules to pass therethrough.

By covering the shielding case 202 with such a film, the shielding case 202 can be closed in airtight state, which allows creating a low vacuum inside the shielding case 202 or filling the inside of the shielding case 202 with inert gas.

Making such a modification allows a low oxygen or zero oxygen state to be formed around the electric charger element 200. By forming such a state around the electric charger element 200, the CNT yarn 200*a*/CNT sheet 1000 included in the electric charger element 200 can be prevented from undergoing oxidization, combustion, and the like of through contact with oxygen in the atmosphere.

(5) In the embodiments, the image forming device 1 is a color MFP having a tandem system. However, the image forming device 1 need not be a color MFP having a tandem system, and for example, may be a color MFP that does not have a tandem system, or may be a monochrome MFP. In addition, the effects described above are similarly achieved when applying the technology pertaining to the present disclosure to, for example, a printer device, a copier with a scanner, or a facsimile device with a facsimile communication function.

Although the technology pertaining to the present disclosure has been fully described by way of examples with reference to the accompanying drawings, it is to be noted that various changes and modifications will be apparent to those skilled in the art.

Therefore, unless otherwise such changes and modifications depart from the scope of the technology pertaining to the present disclosure, they should be construed as being included therein.

What is claimed is:

1. A field effect (FE) electric charger device that electrically charges a surface of a charge-target member, the FE electric charger device comprising:

an electric charger element;

a power source supplying the electric charger element with current; and a lead electrode generating an electric field upon voltage application and causing the electric charger element to discharge, wherein the electric charger element has a density no smaller than 0.4 g/cm3, and comprises a plurality of filaments each comprising a plurality of sp2 carbon molecules bonded together.

2. The FE electric charger device of claim 1, wherein each of the filaments has a diameter no smaller than 40 nm and no greater than 400 nm.

3. The FE electric charger device of claim 1, wherein each of the sp2 carbon molecules has a molecular length no smaller than 0.8 mm and no greater than 2.1 mm.

4. The FE electric charger device of claim 1, wherein the filaments compose a spun yarn.

5. The FE electric charger device of claim 4, wherein the spun yarn has a diameter no smaller than 30 μm and no greater than 120 μm.

6. The FE electric charger device of claim 4, wherein the spun yarn is electrically connected to the power source, with the spun yarn spanning across the power source in tensioned state with both ends of the spun yarn being fixed to the power source.

7. The FE electric charger device of claim 1, wherein the filaments compose a sheet.

8. The FE electric charger device of claim 1, wherein the power source is a metal plate, and the electric charger element is fixed to the metal plate to receive power from the metal plate.

9. The FE electric charger device of claim 1, wherein the sp2 carbon molecules are carbon nanotube, carbon nanohorn, graphene, or graphite.

10. The FE electric charger device of claim 1, wherein voltages applied to the electric charger element and the lead electrode to cause the electric charger element to discharge are no greater than 1 kV, the voltages being an electrical potential difference from a ground potential.

11. An image forming device that uniformly charges a photoreceptor surface, generates an electrostatic latent image by exposing the charged photoreceptor surface to light, transfers a toner image yielded by developing the electrostatic latent image onto a recording sheet, and fixes the toner image onto the recording sheet, the image forming device comprising a field effect (FE) electric charger device that electrically charges a surface of a charge-target member, the FE electric charger device comprising:

an electric charger element;

a power source supplying the electric charger element with current; and a lead electrode generating an electric field upon voltage application and causing the electric charger element to discharge, wherein the electric charger element has a density no smaller than 0.4 g/cm3, and comprises a plurality of filaments each comprising a plurality of sp2 carbon molecules bonded together.

* * * * *